US009634445B1

(12) United States Patent
Brandon et al.

(10) Patent No.: US 9,634,445 B1
(45) Date of Patent: Apr. 25, 2017

(54) ELECTRICAL BUS BAR CONNECTOR SYSTEM

(71) Applicant: Delphi Technologies, Inc., Troy, MI (US)

(72) Inventors: Christopher Alan Brandon, El Paso, TX (US); Daniel S. Eichorn, Auburn Hills, MI (US); Mark Wayne Smith, El Paso, TX (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 15/182,748

(22) Filed: Jun. 15, 2016

(51) Int. Cl.
*H01R 25/16* (2006.01)

(52) U.S. Cl.
CPC ..... *H01R 25/162* (2013.01)

(58) Field of Classification Search
CPC .... H01R 25/162; H01R 13/115; H01R 33/94; H01R 4/4809
USPC ..... 439/790, 839, 786, 792
See application file for complete search history.

(56) References Cited

U.S. PATENT DOCUMENTS 2,916,722 A * 12/1959 Johnson ..... H01R 4/4809 439/752
3,122,604 A * 2/1964 Cook ..... H01R 4/4809 174/51
3,528,050 A * 9/1970 Hindenburg ..... H01R 4/4809 439/535
3,922,052 A * 11/1975 Blevins ..... H01R 12/732 439/510
4,588,240 A * 5/1986 Ruehl ..... H01R 31/08 439/513
4,601,600 A * 7/1986 Karlsson ..... F16B 2/065 403/338
4,802,263 A * 2/1989 Lorber ..... B42F 1/02 24/535
4,884,976 A * 12/1989 Franks, Jr. ..... B23K 37/0435 439/433
5,928,030 A * 7/1999 Daoud ..... H01R 31/08 439/510
7,892,050 B2 * 2/2011 Pavlovic ..... H01R 9/245 439/250
8,388,389 B2 3/2013 Costello et al.
9,257,804 B1 2/2016 Beck et al.
2010/0311286 A1 12/2010 Schrader

* cited by examiner

*Primary Examiner* — Ross Gushi
(74) *Attorney, Agent, or Firm* — Robert J. Myers

(57) ABSTRACT

A bus bar connector system and an electrical distribution center suitable for use in a motor vehicle including such a bus bar connection system is presented. The bus bar connector system includes a first bus bar, a second bus bar, and a spring clip configured to apply a contact force to the first and second bus bars effective to bring at least a portion the first and second bus bars into intimate contact with one another. The spring clip may comprise two longitudinal spring arms each extending from a lateral spring base interconnecting the spring arms. These spring arms are angled toward one another and end portions of the spring arms may be angled away from one another, thereby forming an hourglass or X-shaped spring clip. The end portions of the spring arms may be configured to retain the spring clip within a slot defined by a connector housing.

14 Claims, 7 Drawing Sheets

ELECTRICAL BUS BAR CONNECTOR SYSTEM

TECHNICAL FIELD OF INVENTION

The invention generally relates to electrical connectors and more particularly relates to a system for interconnecting two or more electrical bus bars.

BACKGROUND OF THE INVENTION

Electrical assemblies, such as electrical distribution systems used in motor vehicles, have used bus bars to conduct large currents. The bus bar may conduct current from a power source, such as a vehicle battery, to various electrical loads or components. The bus bars are typically formed from bars of conductive material, e.g. a copper alloy. In some applications, it may be desirable to electrically interconnect two or more bus bars together. Previous solutions for accomplishing these interconnections have involved using fasteners such as bolts and nuts or rivets. Other solutions have used interference fitting of the bus bars, for example a male mating feature on one bus bar and a female mating feature on another. Each of these connection bus bar schemes require special tools to fasten the nuts or rivets or precise tolerances of the mating features to ensure a reliable and low resistance connection between the bus bars. In addition, once assembled, the bus bar assembly may require very precise placement to align the bus bar assembly with electrical contacts or housings. Therefore, a system for interconnecting two or more bus bars that does not require special tools and/or precise tolerances remains to be desired.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

In accordance with one embodiment of this invention, a bus bar connector system is provided. The bus bar connector system includes a first bus bar, a second bus bar, and a spring clip configured to apply a contact force to the first and second bus bars effective to bring at least a portion the first and second bus bars into intimate contact with one another.

The first bus bar may be configured to supply current from a power supply and the second bus bar may be configured to supply current to an electrical device. The spring clip may comprise two longitudinal spring arms extending from a lateral spring base connecting the spring arms. These spring arms may be angled toward one another. End portions of the spring arms may be angled away from one another and the end portions of the spring arms may be configured to retain the spring clip within a slot defined by a connector housing.

The first bus bar may define a longitudinal contact bump protruding from a side of the first bus bar facing the second bus bar.

The electrical conductivity of the material forming the spring clip may be less than the electrical conductivity of the materials forming the first and second bus bars. The bus spring clip may be formed from a spring steel material and the first and second bus bars may be formed of copper-based materials. Alternatively, the spring clip may be formed from a dielectric material while the first and second bus bars are formed of copper-based materials. The bus bar connector system may be configured for use in a motor vehicle.

In accordance with another embodiment of this invention, an electrical distribution center is provided. The electrical distribution center includes a housing containing an electrical device, a first bus bar configured to supply current from a power supply, a second bus bar configured to supply current to the electrical device, and a spring clip disposed within a slot defined by the housing and configured to apply a contact force to the first and second bus bars effective to bring at least a portion the first and second bus bars into intimate contact with one another. The electrical device may be selected from the group consisting of relays and fuses.

The spring clip may comprise two longitudinal spring arms extending from a lateral spring base connecting the spring arms and the spring arms may be angled toward one another. End portions of the spring arms may be angled away from one another. The first and second bus bars are disposed intermediate the spring arms.

Side walls forming the slot may define retaining features protruding from the side walls. The end portions of the spring arms interface with these retaining features to retain the spring clip within the slot.

The first bus bar may define a longitudinal contact bump protruding from a side of the first bus bar facing the second bus bar. The electrical conductivity of the material forming the spring clip may be less than the electrical conductivity of the materials forming the first and second bus bars. The spring clip may be formed from a spring steel material and the first and second bus bars may be formed of copper-based materials.

The housing may comprise a first member and a second member that, when mated, form the housing. The first bus bar may be disposed within the first member prior to mating with the second member and the second bus bar and the spring clip may be disposed within the slot which is defined by the second member.

Further features and advantages of the invention will appear more clearly on a reading of the following detailed description of the preferred embodiment of the invention, which is given by way of non-limiting example only and with reference to the accompanying drawings.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

Presented herein is a bus bar connector system including a spring clip that provides a high current interface between bus bars in a modular solution. The spring clip does this because of its base material properties which produce high normal force between bus bars. It is also a relatively simple geometry compared to a four sided box with an internal spring. The spring clip is based on very simple engineering principles. Two "spring arms" of the spring clip are angled towards each other and are designed to provide equal opposing normal forces to the bus bars through two point contacts of the spring arms. The geometry of the spring clip inhibits the occurrence of an over stressed condition. The bus bars are stacked in the spring clip with the spring contact at the midpoint. A contacting surface of one of the bus bars may be a smooth and flat surface while a contacting surface of another of the bus bar has raised ridges in order to create point contacts between the bus bars. This bus bar connector system is suitable for use in an electrical distribution center such as is used in a motor vehicle.

Figure 1:
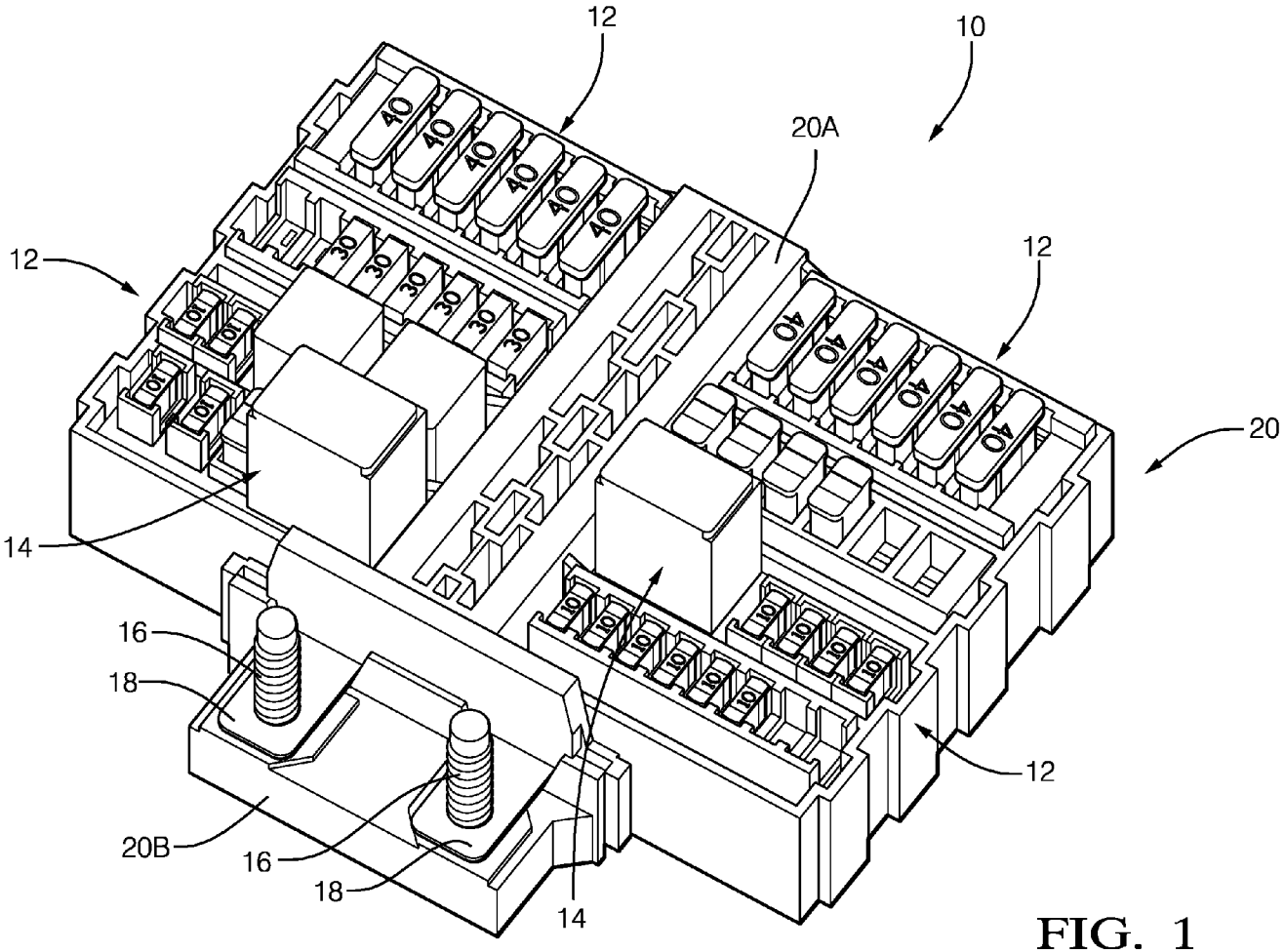
FIG. 1 is perspective view of an electrical distribution center in accordance with one embodiment.

FIG. 1 illustrates a non-limiting example of an electrical distribution center used in a motor vehicle (not shown), hereinafter referred to as a distribution center 10. The distribution center 10 is used to provide electrical power from a main power source (not shown), such as the vehicle battery, to various components, such as motors, lights, controllers, etc. (not shown) throughout the vehicle through wire cables formed into wiring harnesses (not shown) connected between the components and the distribution center 10. The distribution center 10 includes electrical devices such as fuses 12 configured to protect the cables in the wiring harness from overcurrent conditions and relays 14 configured to switch electrical power to selected circuits in the wiring harness on and off. The distribution center 10 further includes terminals 16 that are configured to connect bus bars 18 within the distribution center 10 to the power source. The bus bars 18, fuses 12, relays 14, and terminals 16 are contained in a housing 20 having an upper housing portion, hereinafter referred to as the upper housing 20A, and a lower housing portion, hereinafter referred to as the lower housing 20B.

Figure 2:
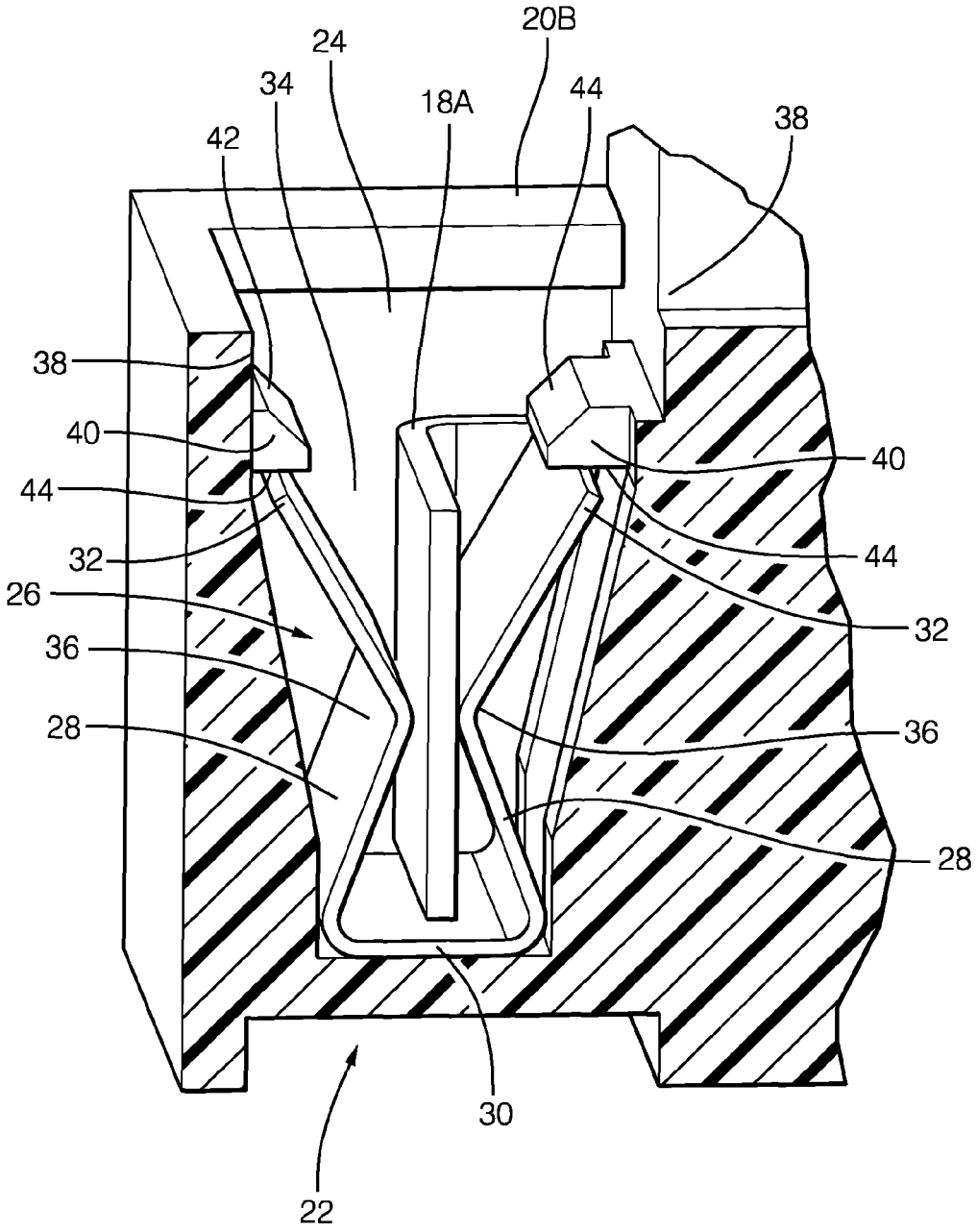
FIG. 2 is a cutaway view of a subassembly of a bus bar connector assembly within the electrical distribution center of FIG. 1 in accordance with one embodiment.

FIG. 2 illustrates a non-limiting example of a bus bar connector system 22 disposed within the distribution center 10. The lower housing 20B defines a groove or slot 24 in which a spring clip 26 is disposed. The spring clip 26 is characterized by a X or hourglass shape having two opposed spring arms 28 attached to a spring base 30. The mesial portions of the spring arms 28 are angled toward one another while the distal ends of the spring arms 28, hereinafter referred to as the spring arm ends 32, are angled away from one another forming the hourglass shape and defining an open end 34 of the spring clip 26 that is configured to receive two or more bus bars 18 and contact points 36 that are configured to apply a contact, clamping, or normal force to the bus bars 18.

Figure 3:
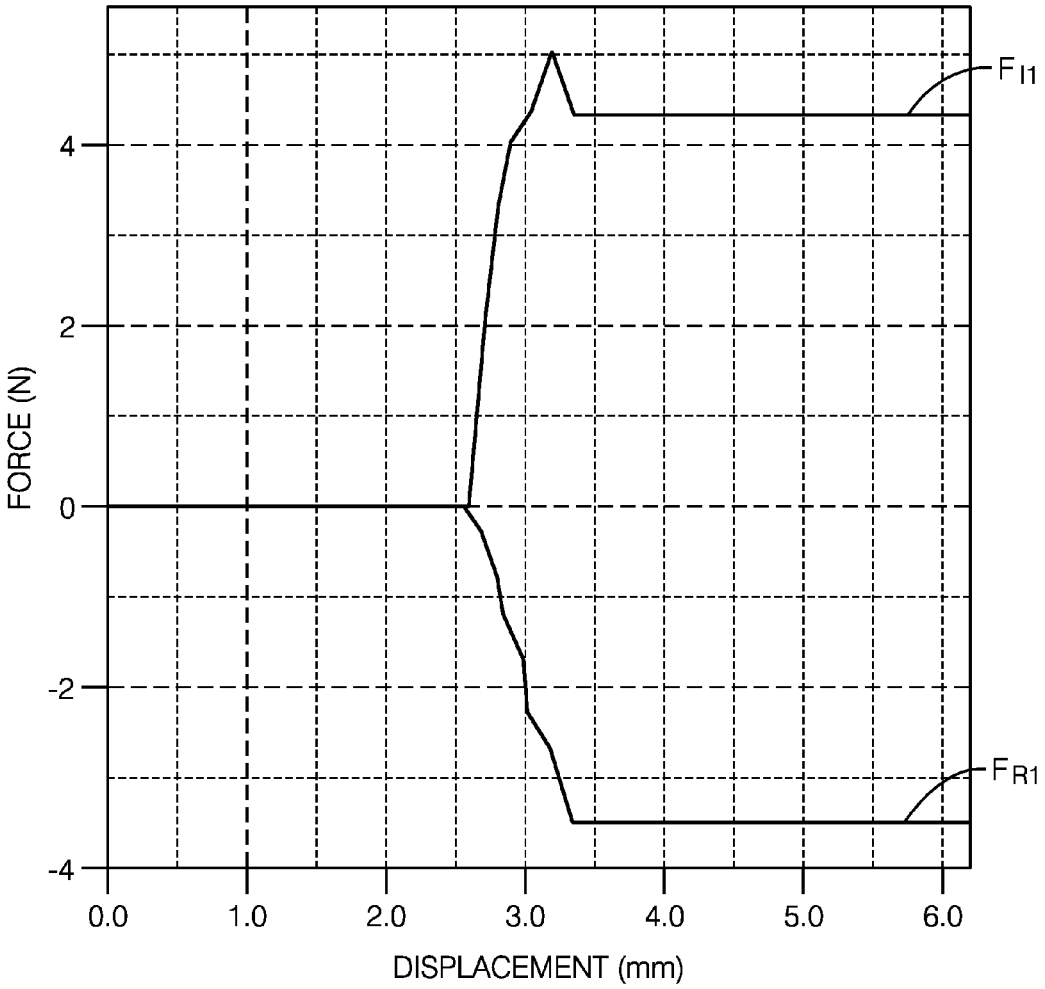
FIG. 3 is a diagram of a force/travel curve for the insertion and removal of a first bus bar from the spring clip as in FIG. 2 in accordance with one embodiment.

As shown in FIG. 2, a first bus bar 18A is disposed in the lower housing 20B and a portion thereof is located between the contact points 36 of the spring clip 26. In this example, the first bus bar 18A is interconnected to one of the terminals 16 of the distribution center 10 and is configured to conduct power from the terminal 16. As shown in FIG. 3, the spring clip 26 exerts a contact force $F_{I1}$ on the first bus bar 18A as it in inserted or removed from the spring clip 26. In the illustrated example, the spring clip 26 exerts a maximum contact force on the first bus bar 18A during insertion of about 6 newtons and exerts a contact force $F_{R1}$ of about 3.5 newtons during removal of the first bus bar 18A from the spring clip 26. The angled spring arm ends 32 facilitates insertion of at least the first bus bar 18A into the spring clip 26.

Returning to FIG. 2, the side walls 38 of the slot 24 define a pair of spring clip retainers, hereinafter referred to as retainers 40. Top surfaces 42 of the retainers 40 are angled relative to the side walls 38 of the slot 24. Bottom surfaces 44 of the retainers 40 are generally perpendicular to the side walls 38 of the slot 24. The width of the spring base 30 is less than the width of the open end 34 between the spring arms 28 and is less than the distance between the retainers 40. As the spring clip 26 is inserted into the slot 24, the spring base 30 will pass between the retainers 40. At some point during insertion, the spring arm ends 32 will contact the top surfaces 42 and the spring arm ends 32 will bend toward each other as they pass between the retainers 40. As the spring clip 26 is further inserted, the spring arm ends 32 will be clear of the retainers 40 and the spring arm ends 32 will snap back to original shape. Engagement of the spring clip 26 ends with the bottom surfaces 44 of the retainers 40 will inhibit removal of the spring clip 26 from the slot 24.

Figure 4:
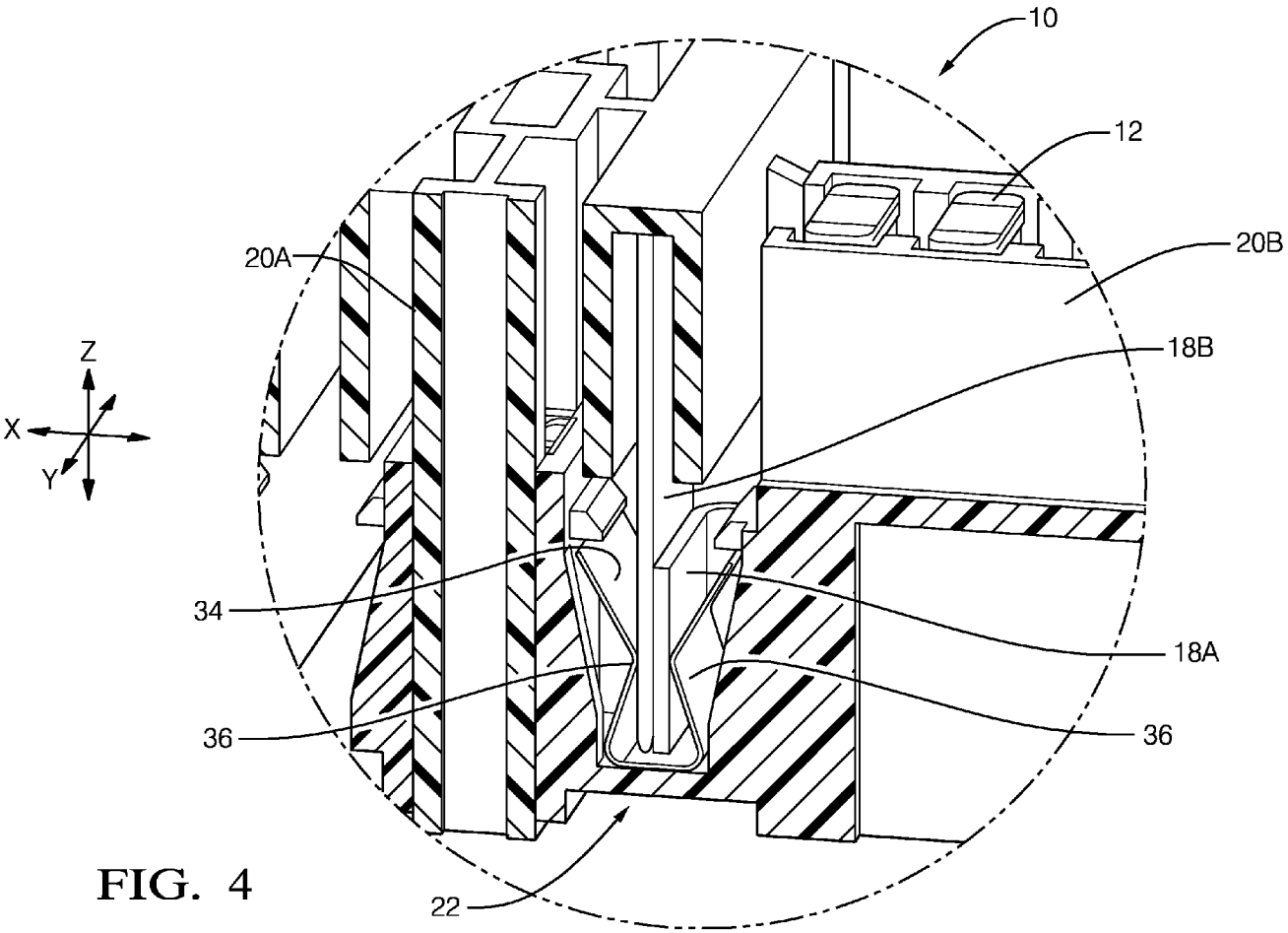
FIG. 4 is a cutaway view of the bus bar connector assembly within the electrical distribution center of FIG. 1 in accordance with one embodiment.

As illustrated in FIG. 4, the upper housing 20A contains a second bus bar 18B that is integral to the upper housing 20A. This second bus bar 18B is configured to conduct electrical power from the first bus bar 18A to the fuses 12 and/or relays 14. When the upper and lower housings 20A, 20B are mated, the second bus bar 18B is also inserted in the open end 34 of the spring clip 26 and the contact points 36 of the spring arms 28 exert a clamping force on the first and second bus bars 18A, 18B to bring them into intimate physical and electrical contact. The geometry of the spring arms 28 is selected so that contact force between the first and second bus bars 18A, 18B is sufficient to conduct the rated current of the first and second bus bars 18A, 18B.

The slot 24 and the spring clip 26 are dimensioned so that there is positional tolerance (play) between the slot 24 and the spring clip 26 along the lateral axis X and transverse axis Y, thus providing positional tolerance in the lateral axis X and transverse axis Y for the first and second bus bars 18A, 18B when connected by the spring clip 26. The opening and contact points 36 of the spring clip 26 also allow positional tolerance along the longitudinal axis Z, thus providing positional tolerance in the longitudinal axis Z for the first and second bus bars 18A, 18B when connected by the spring clip 26. Therefore, the bus bar connector system 22 provides positional tolerance in three orthogonal axes X, Y, Z. This positional tolerance beneficially provides easier assembly and lower manufacturing and assembly costs due to reduced tolerance requirements for the components of the bus bar connector system 22 and the distribution center 10.

Figure 5A:
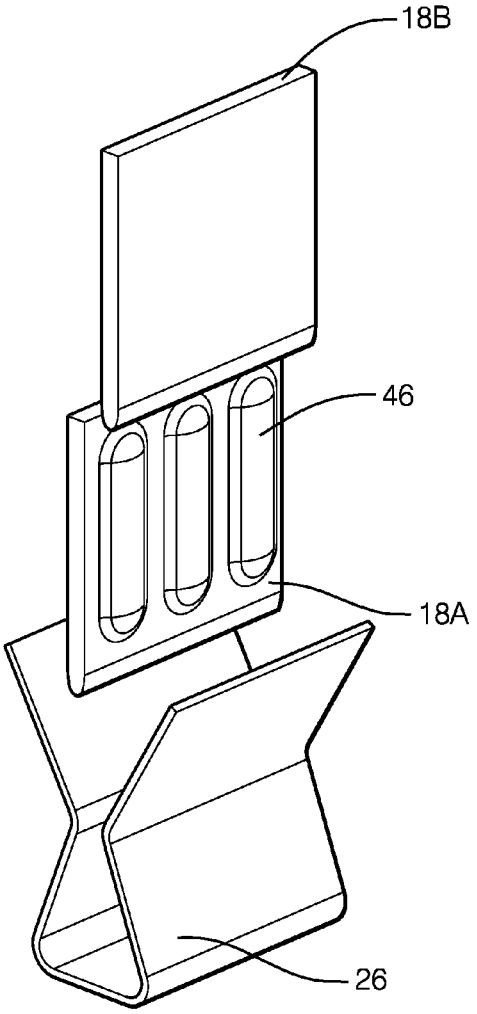
FIG. 5A is an isolated view of the bus bar connector assembly of FIG. 4 in accordance with one embodiment.
Figure 5B:
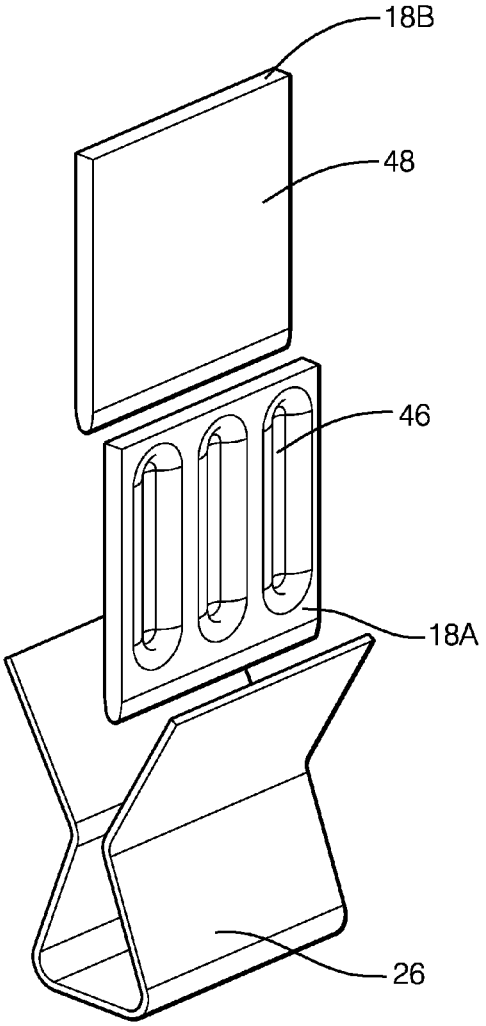
FIG. 5B is another isolated view of the bus bar connector assembly of FIG. 4 viewed from the side opposite that shown in FIG. 5A in accordance with one embodiment.

As illustrated in FIGS. 5A and 5B, the first bus bar 18A defines a plurality of raised longitudinal ridges, hereinafter referred to as contact bumps 46, protruding from a surface of the first bus bar 18A that is facing the second bus bar 18B while the second bus bar 18B has a generally smooth and flat contact surface 48. These contact bumps 46 are known structures configured to provide a point contact between the first and second bus bar 18B in order to improve electrical conductivity between the first and second bus bars 18A, 18B. If a sizeable particle was trapped between two planar surfaces of the bus bars 18A, 18B creating a gap, there would be limited electromechanical contact between the two bus bars 18A, 18B. These contact bumps 46 reduce this risk. Other embodiments of the invention may be envisioned in which the second bus bar 18B defines contact bumps and the first bus bar 18A has a generally smooth and flat contact surface.

Figure 6:
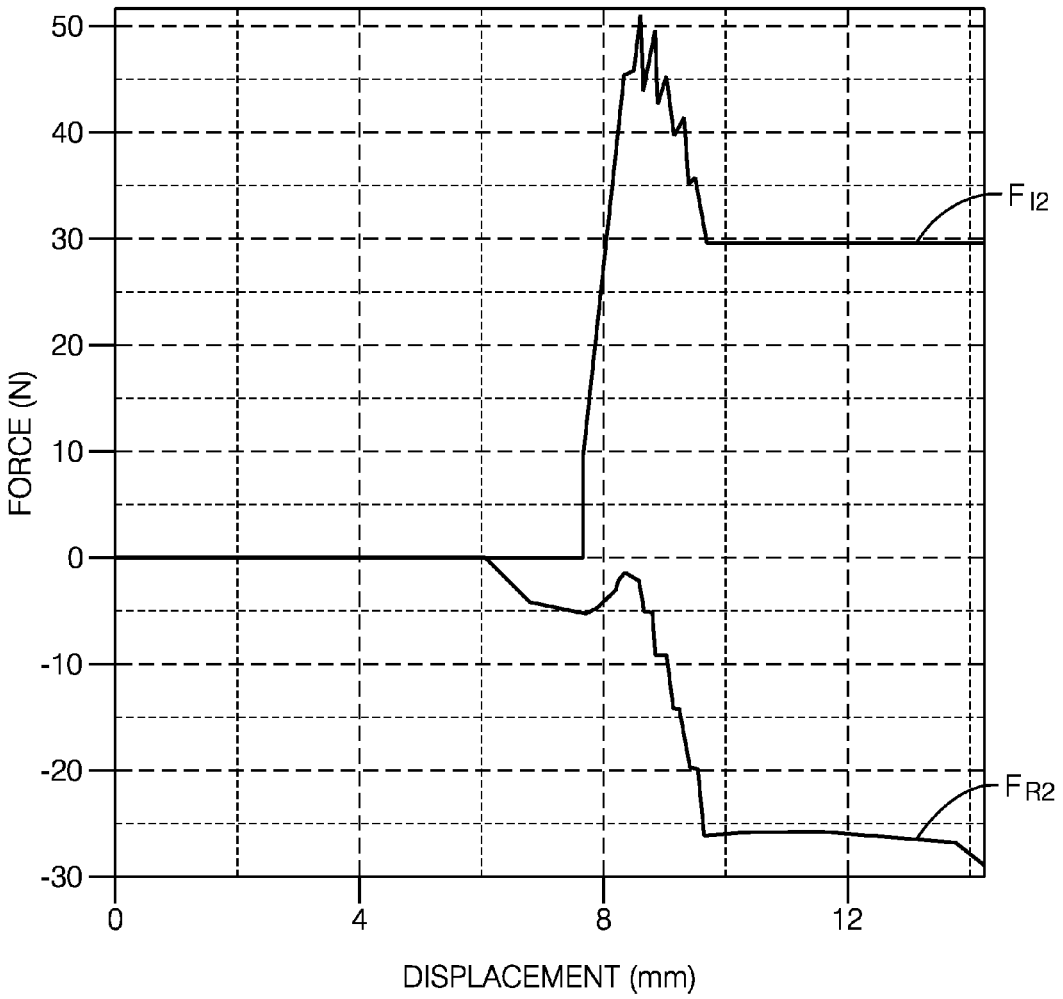
FIG. 6 is a diagram of a force/travel curve for the insertion and removal of a second bus bar from the spring clip as in FIG. 4 in accordance with one embodiment.

As shown in FIG. 6, the spring clip 26 exerts a contact force on the second bus bar 18B as it is inserted or removed from the spring clip 26 that is higher than the contact force exerted on just the first bus bar 18A. In the illustrated example, the spring clip 26 exerts a maximum contact force $F_{I2}$ during insertion of the second bus bar 18B of about 50 newtons and exerts a contact force $F_{R2}$ of about 25 newtons during removal of the second bus bar 18B from the spring clip 26.

The spring clip 26 may be formed of a spring steel material while the first and second bus bars 18A, 18B are formed from a material having a higher conductivity, such as a copper-based alloy material. Without subscribing to any particular theory of operation, the material forming the spring clip 26 may have a lower conductivity than the material forming the first and second bus bars 18A, 18B, since the current flowing through the interface between the first and second bus bars 18A, 18B will flow primarily through the first and second bus bars 18A, 18B. Embodiments of the invention may be envisioned in which the spring clip 26 is formed of a non-conductive (dielectric) material, e.g. a polymer-fiber composite, as long as the material is configured to provide a sufficient clamping force between the first and second bus bars 18A, 18B.

Other embodiments of the invention may be envisioned in which a third bus bar (not shown) configured to conduct power from the first bus bar 18A to additional devices is disposed within the spring clip 26.

Figure 7A:
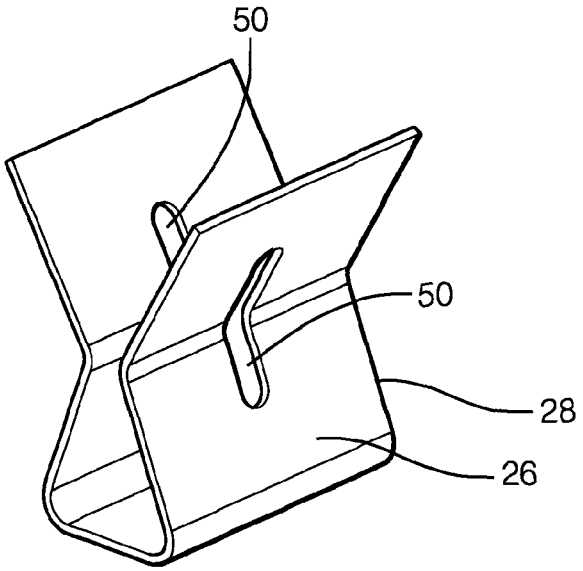
FIGS. 7A and 7B are perspective views of alternative spring clip designs in accordance with one embodiment.
Figure 7B:
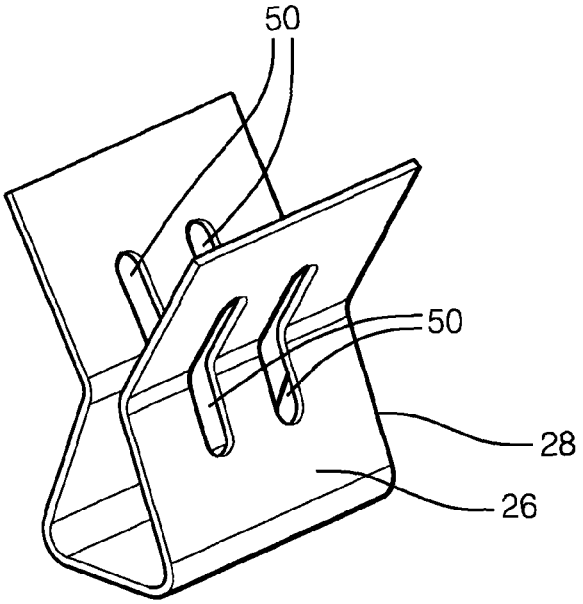

FIGS. 7A and 7B illustrate non-limiting examples of alternative designs for the spring clip 26 in which the spring clip 26 defines on or more longitudinally elongated slots 50 in each of the spring arms 28. Without subscribing to any particular theory of operation, these elongated slots 50 may improve electrical conductivity between the bus bars 18A, 18B and the spring clip 26.

Accordingly, a bus bar connector system 22 and an electrical distribution center 10 employing such a bus bar connector system 22 is provided. The spring clip 26 provides greater dimensional and alignment variation during assembly and also tolerates movement between the first and second bus bars 18A, 18B after assembly that may be caused by movement; e.g. thermal expansion or vibration effects. The bus bar connector system 22 can be assembled without the need of special tools or equipment. The geometry of the spring arms 28 makes an over stressed condition within the bus bar connector system 22 or distribution center 10 very unlikely. The design of the spring arms 28 is scalable to provide the appropriate contact force between the first and second bus bars 18A, 18B based on bus bar thickness and current rating.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

We claim:

1. An electrical distribution center configured for use in a motor vehicle, comprising:

a housing containing an electrical device;

a first bus bar configured to supply current from a power supply;

a second bus bar configured to supply current to the electrical device; and a spring clip disposed within a slot defined by the housing and configured to apply a contact force to the first and second bus bars effective to bring at least a portion the first and second bus bars into intimate contact with one another, wherein the spring clip comprises two longitudinal spring arms extending from a lateral spring base connecting the spring arms and wherein the spring arms are angled toward one another, wherein spring arm ends are angled away from one another, wherein side walls forming the slot define retaining features protruding from the side walls and wherein the spring arm ends interface with said retaining features to retain the spring clip within the slot.

2. The electrical distribution center according to claim 1, wherein the first bus bar defines a longitudinal contact bump protruding from a side of the first bus bar facing the second bus bar.

3. The electrical distribution center according to claim 1, wherein the electrical conductivity of the material forming the spring clip is less than the electrical conductivity of the materials forming the first and second bus bars.

4. The electrical distribution center according to claim 3, wherein the spring clip is formed from a spring steel material and the first and second bus bars are formed of copper-based materials.

5. The electrical distribution center according to claim 1, wherein the electrical device is selected from the group consisting of relays and fuses.

6. The electrical distribution center according to claim 1, wherein the first and second bus bars are disposed intermediate the spring arms.

7. An electrical distribution center configured for use in a motor vehicle, comprising:

a housing containing an electrical device;

a first bus bar configured to supply current from a power supply;

a second bus bar configured to supply current to the electrical device; and a spring clip disposed within a slot defined by the housing and configured to apply a contact force to the first and second bus bars effective to bring at least a portion the first and second bus bars into intimate contact with one another, wherein the housing comprises a first member and a second member that, when mated, form the housing, wherein the first bus bar is disposed within the first member prior to mating with the second member, and wherein the second bus bar and the spring clip are disposed within the slot which is defined by the second member.

8. The electrical distribution center according to claim 7, wherein the spring clip comprises two longitudinal spring arms extending from a lateral spring base connecting the spring arms and wherein the spring arms are angled toward one another.

9. The electrical distribution center according to claim 8, wherein the first and second bus bars are disposed intermediate the spring arms.

10. The electrical distribution center according to claim 8, wherein spring arm ends are angled away from one another.

11. The electrical distribution center according to claim 7, wherein the first bus bar defines a longitudinal contact bump protruding from a side of the first bus bar facing the second bus bar.

12. The electrical distribution center according to claim 7, wherein the electrical conductivity of the material forming the spring clip is less than the electrical conductivity of the materials forming the first and second bus bars.

13. The electrical distribution center according to claim 12, wherein the spring clip is formed from a spring steel material and the first and second bus bars are formed of copper-based materials.

14. The electrical distribution center according to claim 7, wherein the electrical device is selected from the group consisting of relays and fuses.

* * * * *